United States Patent [19]

Oram

[11] Patent Number: 4,462,328

[45] Date of Patent: Jul. 31, 1984

[54] SHIP HULL CLEANING DEVICE

[76] Inventor: Stephen W. Oram, 227 N. Winter St., Adrian, Mich. 49221

[21] Appl. No.: 441,424

[22] Filed: Nov. 15, 1982

Related U.S. Application Data

[63] Continuation-in-part of Ser. No. 222,250, Jan. 2, 1981, abandoned.

[51] Int. Cl.[3] ..... B63B 59/10
[52] U.S. Cl. ..... 114/222
[58] Field of Search ..... 114/222; 51/410

[56] References Cited

U.S. PATENT DOCUMENTS

| | | | |
|---|---|---|---|
| 318,814 | 5/1885 | Spier . | |
| 333,503 | 1/1886 | Cross . | |
| 693,242 | 2/1902 | Culpepper . | |
| 826,012 | 7/1906 | Beelendorf . | |
| 2,543,348 | 2/1951 | Briese | 51/410 |
| 3,609,916 | 10/1971 | Hammelmann . | |
| 3,859,948 | 1/1975 | Romano et al. | 114/222 |

FOREIGN PATENT DOCUMENTS

| | | | |
|---|---|---|---|
| 399708 | 7/1923 | Fed. Rep. of Germany | 114/222 |
| 55-68497 | 5/1980 | Japan | 114/222 |

OTHER PUBLICATIONS

The Zero Thrust Gun shown in Marine Engineering-/Log International, Feb. 1978, p. 59.

*Primary Examiner*—Trygve M. Blix
*Assistant Examiner*—Thomas J. Brahan
*Attorney, Agent, or Firm*—Gifford, VanOphem, Sheridan, Sprinkle & Nabozny

[57] ABSTRACT

A cleaning device for removing foulant from the hull of a sea going vessel comprising a carriage, a plurality of cleaning nozzles secured to the carriage, a reactor nozzle aligned to produce a reactive force which opposed the force component of the cleaning nozzles which tends to urge the carriage away from the hull of a ship, and control members for displacing the carriage across the hull surface of the vessel. The control member can be flexible, in which case the reactor nozzle is also aligned to tension the control members. In any case, the control members provide remote control of the carriage throughout a regular pattern of predetermined paths.

14 Claims, 4 Drawing Figures

SHIP HULL CLEANING DEVICE

CROSS REFERENCE

This application is a continuation-in-part of application Ser. No. 222,250, filed Jan. 2, 1981, now abandoned.

BACKGROUND OF THE INVENTION

I. Field of the Present Invention

The present invention relates generally to cleaning devices which hydraulically or mechanically abrade the surface of a ship's hull to remove any accumulated deposits therefrom and, more particularly, to a carriage for controlling the movement of such cleaning devices across the hull surface of a ship.

II. Description of the Prior Art

A well-known problem encountered by seagoing vessels is that foulant such as barnacles, marine plant growth and the like accumulate upon the ship's hull. Such foulant increases the drag as the ship moves through water and therefore increases fuel comsumption and reduces the top speed of the ship. Consequently, the hulls must be cleaned periodically to remove the foulant and thus avoid the high cost of inefficient operation of the vessel. In addition to the energy savings, hull cleaning maintains the productivity of each vessel, and as a result, initial fleet investment can be minimized.

A known means for removing the foulant comprises scrapping or chiseling the foulant from the hull surface. However, manual scraping of the hull surface is extremely tedious and time comsuming. Moreover, manual scraping is best accomplished in dry dock and, therefore, prolongs the time during which the ship is not available for service.

An improved means for scraping the hull comprises the use of powered rotating brushes which are mounted on a manually guided, wheeled platform. Although such scrubbing devices have been adapted for use below the waterline while the ship is achored, they are difficult to control. Consequently, they are typically transported and controlled by a vessel separate from the vessel to be cleaned.

Another previously known manner for removing foulant comprises the use of a highly pressurized flow of fluid through a hose and against the foulant on the hull surface. The fluid can be water, or a combination of particulate matter and water, although it is typically highly pressurized air containing particulate matter which is discharged with great force against the foulant. The use of particulate matter as an abrasive medium is disadvantageous in that the particles can pit the surface of the hull and remove the paint from the surface. In addition, as the particles are deflected from the surface, they are released into the atmosphere and present undesirable safety and environmental consequences.

Thus, another previously known means for removing foulant comprises the use of only pressurized water. The pressurized water is delivered through a hose having a nozzle at the end which increases the force of the fluid stream discharge.

Moreover, due to the fact that foulant tightly adheres to the surface of the ship's hull, extremely high pressures must be generated in order to blast the foulant from the hull. Thus, although a single hose can be manipulated rather easily, and is typically held by a worker who directs the flow against the hull of the ship, it is only practical for each worker to control a single nozzle.

Although the use of high pressure water is highly effective in removing barnacles from the hull of a ship, the flow from the single nozzle contacts only a very limited area of the hull's surface. Thus, the cleaning of large vessels remains extremely time-consuming. Although this downtime is extremely costing in terms of the service lost as well as storage costs, the necessity for removing the foulant dictates that the delay be tolerated.

Of course, it would be advantageous to increase the area contacted by the pressurized fluid stream. However, the pressure required to remove the foulant causes a large force to be exerted against the hull of the ship which pushes the nozzle away from the hull. Resistance to this pushing force is provided by the worker who handles the nozzle. Because of the magnitude of the force which must be resisted by the worker, it has not been practical or possible for the worker to operate more than one nozzle in order to increase the cleaning swath and thereby decrease cleaning time. Moreover, the large forces created by nozzles presents a serious risk that two or more workers working together, each operating a single nozzle, can cause serious injury to co-workers. Consequently, it has not been practical to utilize more than a single nozzle at one location during the hull cleaning operation.

SUMMARY OF THE PRESENT INVENTION

The present invention overcomes the above-mentioned disadvantages by providing a cleaning device incorporating a carriage that supports a plurality of cleaning means so that they can be operated and moved across the hull of a ship automatically. The invention provides a novel means for maintaining the position of a plurality of high pressure nozzles against the hull and a novel means for controlling movement of the carriage across the hull surface, both novel means comprising at least one reactor nozzle discharging fluid away from the hull. Thus, the device includes reactor nozzle means for resisting any forces exerted against the hull by high pressure cleaning nozzles which tend to push the carriage away from the hull surface. In addition, the reactor nozzle means provides control of independently operated, elongated, control members for moving the carriage in a predetermined path along the surface of the hull.

In one embodiment the device generally comprises a carriage, a plurality of cleaning nozzles facing outwardly from one surface of the carriage and a manifold carried by said carriage to provide a supply of pressurized fluid to the nozzles. The carriage is supported a predetermined distance away from the surface of the hull by a support means such as swiveling casters so that the carriage is easily moved about the surface of the hull. Translational control means for moving the carriage across the hull preferably comprises flexible horizontal and vertical elongated elements such as cables. The vertical and horizontal members are secured at one of their ends to the carriage. The other end of each member is secured to an extension/retraction means, such as a winch, which can be mounted at one of a plurality of positions with respect to the hull. Thus, the substantially 90° optimum relationship between the members 20 and 22 shown in the preferred embodiment illustrated in the drawing can be maintained across the length of the hull. A means for tensioning the members permits actuation of the winches to provide accurate displacement of the carriage about a large area of the hull surface in a repetitive pattern.

The means for resisting the force of the cleaning nozzles and thereby maintaining the carriage casters against the hull, preferably comprises at least one reactor nozzle extending outwardly from the carriage surface opposite to the surface carrying the cleaning nozzles. In the preferred embodiment, a single reactor nozzle is positioned so that the reaction force applied to the carriage by the nozzle directly opposes the effective force vector produced by the plurality of the cleaning nozzles which tends to push the carriage away from the hull. In addition, the reactor nozzle is aligned so as to create a force component which tends to maintain the support members in a tensioned condition. Preferably, the nozzle alignment is adjustable so that the placement of the winch members can be varied. In addition, supplemental contol of the carriage can be provided by at least one fin secured on the carriage and aligned so that movement of the ship hull through a body of water urges the carriage against the ship's hull and tensions the support members. Thus, the energy needed to position and control the cleaning device can be reduced, without affecting the operation of the device.

Thus, the present invention provides a device for controlled cleaning of foulant from the surface of a ship's hull. The carriage is adapted to carry a plurality of cleaning nozzles so that a wider area or swath of the hull can be cleaned in a given time. The reactor nozzle provides sufficient resistance to the force exerted against the hull by the cleaning nozzles to restrain the cleaning device against the hull of the ship. Moreover, since the carriage is moved across the surface of the ship automatically by simple, remotely secured driving means, workers are not exposed to the risk of injury from the high-pressure cleaning nozzles. In addition, the device is especially useful in that it reduces the amount of time that was previously necessary in order to completely remove the foulant from the hull, particularly when a plurality of cleaning devices are used simultaneously.

It will be understood that cleaning means other than high-pressure nozzles, such as the previously known rotary brushes, or other means for abrading the hull surface can be advantageously used with this controlled pattern carriage device. Moreover, it will be understood by those skilled in the art that the device permits cleaning of the hull in dry dock or while the ship is at anchor. In fact, with the addition of stabilizing fins on the carriage to maintain positioning of the carriage, it is possible to accomplish cleaning while the ship is underway at a substantial reduction of energy input to the device by reducing the horsepower requirements of the pump used to supply pressurized fluid to the nozzles.

BRIEF DESCRIPTION OF THE DRAWING

The present invention will be more clearly understood by reference to the following detailed description of a preferred embodiment of the present invention and the accompanying drawing in which like reference characters refer to like parts throughout the several views and in which.

DETAILED DESCRIPTION OF A PREFERRED EMBODIMENT OF THE PRESENT INVENTION

Figure 1:
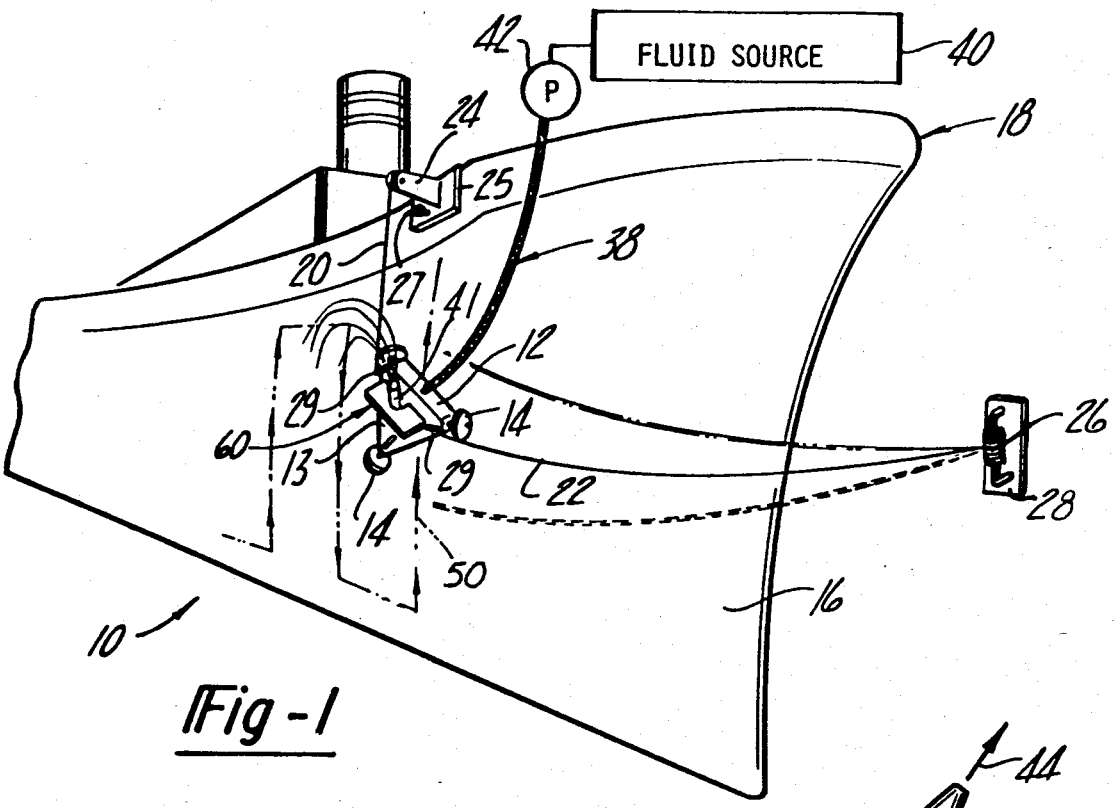
FIG. 1 is a perspective view of the cleaning device of the present invention positioned on a ship's hull during the cleaning operation.

Referring now to FIG. 1, the present invention 10 is thereshown comprising a carriage 12 mounted on casters 14 for rolling movement along the hull surface 16 of the ship 18. The carriage is movably supported adjacent the hull by elongated retaining cables 20 and 22 secured at one end of the carriage. The other end of the cable 20 is wound on a winch 24 which is secured to the deck of the ship 18 by means for removably securing the winch to the ship such as the gunwale engaging bracket 25 having a channel adapted to receive the top edge of the gunwale. The bracket 25 is lockingly secured to the gunwale by the locking bolt 27. Means for operating the winch (not shown) permit the cable 20 to be extended and retracted vertically. Similarly, the other end of the cable 22 is wound around a winch 26. The winch 26 is shown secured to a dry dock wall 27, although it could also be secured to the bow or deck of the ship 18 in the same manner as winch 24. Means for controlling the winch 26 (not shown) permit the carriage 12 to be translated in a horizontal direction. It should be understood that the winches 24 and 26 can be mounted at any desired position along the side of the ship so long as they are spaced apart in a manner to be described in detail hereinafter.

Figure 2:
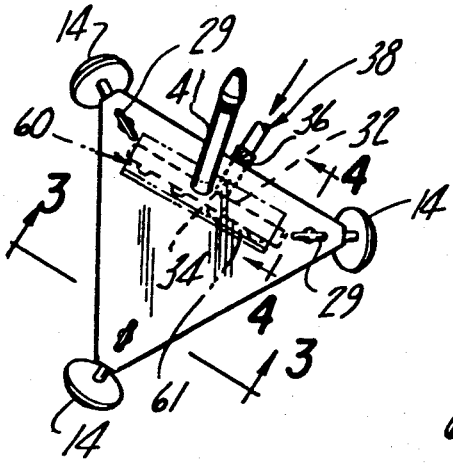
FIG. 2 is a top plan view of the cleaning device of the present invention.
Figure 3:
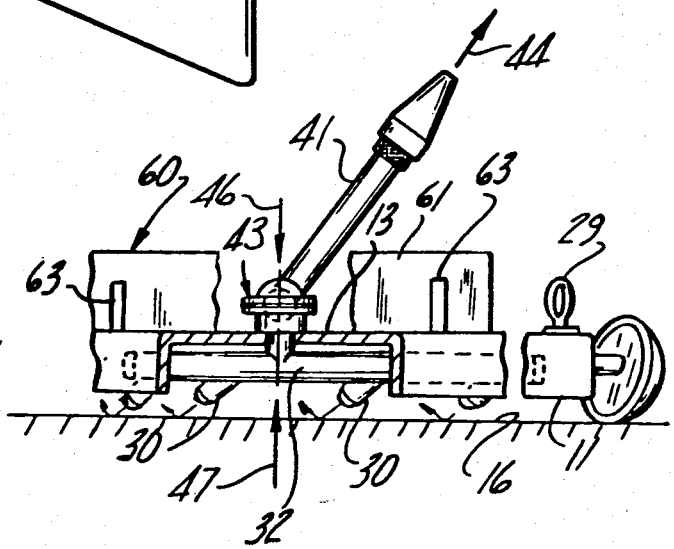
FIG. 3 is a sectional elevational view taken substantially along the line 3—3 in FIG. 2.
Figure 4:
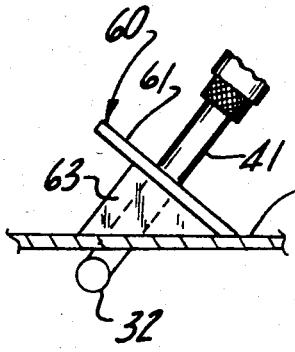
FIG. 4 is a sectional view taken substantially along the line 4—4 in FIG. 2.

As best shown in FIGS. 2 and 3, a plurality of cleaning nozzles 30 extend outwardly from the bottom surface of the carriage 12. The nozzles 30 fluidly communicate with fluid passageways of a manifold 32. The inlet passage 34 of the manifold 32 fluidly communicates with the fluid coupling 36 secured to the outside of the carriage 12. A hose 38 is mated with the coupling 36 to provide fluid communication between a remotely positioned fluid source 40 via pump 42 (see FIG. 1) and the manifold 32.

Although the nozzles 30 can be aligned substantially normal to the surface 11 of the carriage 12, and thus substantially normal to the surface of the hull in order to permit the full florce of the fluid discharged from the nozzle to directly impinge upon the foulant on the surface of the hull, as shown in FIG. 3, the nozzles 30 are inclined with respect to the surface of the hulll for a reason to be hereinafter described.

Preferably the nozzles 30 are arranged so that a wide path beneath the carriage 12 is cleaned as the carriage moves in an arcuate path along the hull. It is to be understood that the nozzles 30 are not limited to the particular arrangement disclosed in the drawing, so long as the arrangement of nozzles provides a cleaning swath beneath a large portion of the area beneath the carriage 12 as the carriage is displaced along the surface of the hull.

Extending outwardly from the top surface 13 of the carriage 12 is a reactor nozzle 40. A nozzle 40 is secured by rotatable pivot means 42 to the carriage 12 and in fluid communication with the manifold 32. The rotatable pivot means 42 enables the direction and inclination of the nozzle axis 44 to be selectively adjusted so that the force of the flow stream discharged from the nozzle can be aligned as desired. Preferably, the rotatable pivot means 42 is fixedly secured with respect to the carriage 12 at a point which coincides with the effective center point of the forces defined by the discharge from the cleaning nozzles 30. Thus, as shown in FIG. 3, the reaction force component 46 of the fluid discharged along axis 44 from the nozzle 40 can directly oppose the effective force 47 exerted by the cleaning nozzles 30 in order to maintain the carriage 12 closely adjacent the hull's surface 16.

Referring again to FIG. 1, the nozzle 40 is shown inclined in a direction which substantially bisects the angle between the retaining cable 20 and retaining cable 22. Thus, one component of the force vector along axis 44 tensions the cables 20 and 22. Consequently, extension or retraction of the cables 20 and 22 by the winches 24 and 26, respectively, causes respective vertical and horizontal translation of the carriage 12 across the hull surface 16. As shown in FIG. 3, the nozzles 30 are also inclined so as to provide a force vector which enhances the tension force upon the cables 20 and 22.

The reaction force holding the carriage against the ship's hull can be supplemented by a fin 60 secured to the top of the carriage 12. The fin 60 can be a flat panel 61 secured by welded gussets 63 to the top surface 13 of the carriage 12. The panel is aligned so that the force of water flowing past the carriage 12 when the carriage is submerged pushes the carriage against the ship's hull. Thus, the fin is inclined upwardly toward the trailing portion of the carriage 12. In addition, the fin 60 is aligned substantially perpendicular to a line which bisects the angle between cables 20 and 22 so that the tension on cables 20 and 22 is supplemented.

Having thus described the important structural features of the present invention, the operation of the cleaning device of the present invention is easily explained. The winch 24 is removably secured in a fixed position to the deck of the ship 18. For example, the bracket 25 is slidable along the gunwale but can be locked at any desired position therealong. While the same can be true for winch 26, the drawing shows the winch 26 removable secured to a wall portion of the dry dock at or near the water line on the hull surface 16. The ends of the cables 20 and 22 are secured to the couplings 29 on the carriage 12. The nozzle 40 is then aligned so as to substantially intersect the angle between the cables 20 and 22 as shown in FIG. 1. In this manner, the device is prepared for cleaning the bow portion of the hull 16.

The nozzle 40 is also inclined with respect to the surface 13 of the carriage 12 such that the reaction force component 46 exceeds and directly opposes the sum 47 of the reactive force components from the cleaning nozzles 30. The pump 42 is then activated to provide a pressurized flow of fluid from source 40 through the hose 38 and into the manifold 32. The manifold 32 thus supplies pressurized fluid to the cleaning nozzles 30 as well as the reactor nozzle 40. As the fluid is discharged from all of these nozzles, the reaction force component 46 from the nozzle 40 slightly exceeds and directly opposes the force component 47 from the cleaning nozzles 30. Thus, the casters 14 are urged against the hull surface 16 and maintain the nozzles 30 substantially a predetermined distance above the hull surface 16. Consequently, the carriage 12 follows the contour of the ship's hull as the length of the members 20 and 22 is varied. At the same time, one component of the force vector 44 retains the members 20 and 22 in tension. The force components can be supplemented by one or more fins 60 as shown in the drawing, which urge the carriage against the hull and tension the cables as water passes over the fins when the ship is moving.

The members 20 and 22 are preferably operated so that the carriage 12 moves in a regular pattern of discrete, predetermined paths across the hull of the ship as shown at 50 in FIG. 1. For instance, the carriage 12 can be initially positioned at the water line of the hull 16 as shown in FIG. 1. The winch 24 is then operated so that the cable 20 extends downwardly to permit the carriage 12 to descend along the hull of the ship. Once the carriage 12 reaches the keel or lowermost portion of the ship, the winch 26 retracts the cable 22 slightly so that a second swath directly adjacent to the first swath traversed can be cleaned. Preferably, the cable is retracted a distance less than the width of the swath cleaned beneath the carriage so that the second swath at least partially overlaps the first swath. The cable 20 is then retracted by winch 24 so that the carriage is moved upwardly toward the water line. Upon reaching the top water line again, the cable 22 is again retracted a short distance to displace the carriage adjacent the area just cleaned by the nozzles. It is also desirable to reposition the winch 24 along the gunwale to maintain a substantially perpendicular relationship between cables 20 and 22. Such repositioning would preferably incorporate displacement of the winch a multiple of the distance less than the width of the swath by which cable 22 is retracted. The operation is then repeated across the entire underwater surface of the ship. Since both the cables are tensioned by the alignment of the reactor nozzle 40, a substantially regular pattern of carriage movement is provided. The tension can be supplemented by applying fin 30, and thus, the amount of fluid needed to be pumped through the reactor nozzle.

Moreover, it will be understood that the direction of the swath traversed by the carriage can be changed by rearrangement of the winches 24 and 26 and realignment of the nozzle 40. For example, the winches 24 and 26 can be mounted at opposite ends of the deck of the ship. Then by varying the rotational position of the reactor nozzle 40, the respective extension and retraction of the cables 20 and 22 causes the carriage to traverse a plurality of patterns which effectively cover substantially the entire hull surface below the water line on one side of the ship.

On the other hand, as shown in the drawing, the winches are positioned for movement of the carriage across one side of the bow of the ship. It is to be understood that such positioning enables additional winches and carriages to be positioned on the same side of the ship so that other portions of the same side can be cleaned at the same time. Consequently, the hull can be cleaned in substantially less time than was previously possible.

As a practical matter, it will be understood that the weight of the carriage which must be controlled varies due to the amount of water carried in the supply line 38 as well as the length to which the cables 20 and 22 are extended. In any event, test results show that a device adapted to discharge fluid at 1500 psi through five cleaning nozzles, each have a 1.5 millimeter diameter aperture, with an input fluid pump supplying 100 gallons per minute to the hull surface and aligned perpendicular to the line bisecting horizontal and vertical control members, will support a 30 lb. prototype carriage against a vertical surface while tensioning the control members. Nevertheless, greater pressures and flow rates will compensate for the added weight of the cable, and the pressure is likely to be substantially greater under normal working conditions.

Thus, the present invention provides a hull cleaning device which enables a plurality of high pressure nozzles or other means to be used to remove foulant from the ship's hull. Since the nozzles or other means are mounted to a single carriage, the cleaner permits a wider swath to be cleaned than would be possible using only a single nozzle manually controlled by a worker. Moreover, since the carriage is remotely controlled, it eliminates the dangers that a worker would be exposed to by the highly pressurized discharge from the nozzles. Consequently, more than one carriage can be utilized at the same time on a single vessel. In addition, the time during which the ship must be confined to dry dock is substantially reduced. Moreover, while the fluid discharged by the nozzles is water in the preferred embodiment, to thereby avoid contamination of the atmosphere by particulate matter, it will also be understood by those skilled in the art that the device of the present invention is operable with other nozzles and liquid or gaseous fluids including those containing particulate materials.

Having thus described my invention, many modifications thereto will become apparent to those skilled in the pertinent art without departing from the scope and spirit of the present invention as defined in the appended claims.

What is claimed is:

1. An apparatus for controlled cleaning of foulant from the hull of a water vessel comprising:

a carriage including first means for movably supporting the carriage on the hull surface;

second means for discharging a pressurized fluid against the hull surface to remove foulant from the hull including a plurality of high pressure cleaning nozzles for removing foulant from the ship's hull, mounted on said carriage, said means emitting an unconstrained fluid discharge aimed toward the hull surface;

third means for remotely displacing said carriage across the hull surface;

nozzle means for maintaining said carriage against the hull surface by discharging fluid under pressure away from said hull surface to counteract the force exerted by said high pressure cleaning nozzles that tends to separate said carriage from said hull; and fourth means for supplying a pressurized cleaning fluid to said plurality of high pressure cleaning nozzles and said nozzle means.

2. The invention as defined in claim 1 wherein said third means comprises:

(a) first and second elongated control members;

(b) fifth means for controlling the length of each said control member adjacent the ship's hull; and (c) sixth means for aligning said fourth means to tension said control members.

3. The invention as defined in claim 2 wherein the fluid comprises air.

4. The invention as defined in claim 2 wherein said sixth means for aligning comprises means for maintaining said first and second members at substantially a 90° angle with respect to each other.

5. The invention as defined in claim 2 wherein said nozzle means comprises at least one nozzle and means for pivotally and rotatably mounting each said nozzle to said carriage whereby the inclination and direction of the nozzle discharge are selectively adjustable.

6. The invention as defined in claim 2 and further comprising at least one fin inclined with respect to the hull surface and aligned obliquely with respect to the said control members upon said carriage, whereby when the hull surface to be cleaned is submerged in and moved through a body of water, said carriage is urged toward said hull surface and urged in the direction opposite from the direction of movement of the ship, and said control members are tensioned.

7. The invention as defined in claim 2 wherein said fifth means comprises first and second winch means for winding said first and second members, respectively, independently of each other so that the length of said first member can be varied while the length of said second member remains constant and thereby defines a discrete, predetermined path of movement for the carriage.

8. The invention as defined in claim 7 wherein said first winch means includes means for removably securing said winch means with respect to the gunwale so that said winch means can be secured at one of a plurality of positons along the hull.

9. The invention as defined in claim 1 wherein said third means further comprises means for moving the carriage through a pattern of movement comprising a plurality of discrete, predetermined paths.

10. The invention as defined in claim 1 wherein said first means comprises fifth means for substantially maintaining said high pressure nozzle means at a predetermined distance from the hull surface.

11. The invention as defined in claim 10 wherein said fifth means comprises casters.

12. The invention as defined in claim 1 wherein the fluid comprises water.

13. The invention as defined in claim 1 wherein said fourth means comprises a fluid manifold in fluid communication with said high pressure cleaning nozzles and said nozzle means and further comprising a single supply conduit in fluid communication with said manifold.

14. An apparatus for controlled cleaning of foulant from the hull of a water vessel comprising:

a carriage including first means for movably supporting the carriage on the hull surface;

a cleaning means for removing foulant mounted on said carriage and aimed toward the hull surface;

second means for displacing said carriage across the hull surface comprising:

(a) first and second elongated control members;

(b) fifth means for controlling the length of each said control member adjacent the ship's hull; and (c) nozzle means for maintaining said carriage against the hull surface by discharging fluid under pressure away from said hull surface to counteract the force exerted by said first means that tends to separate said carriage from said hull, and for tensioning said control members;

fourth means for supplying a pressurized cleaning fluid to said cleaning means and said nozzle means, wherein said nozzle means comprises at least one nozzle and means for pivotally and rotatably mounting each said nozzle to sald carriage whereby the inclination and direction of the nozzle discharge are selectively adjustable;

wherein said fourth means comprises first and second winch means for winding said first and second members, respectively, independently of each other so that the length of said second member remains constant and thereby defines a discrete predetermined path of movement for the carriage.

* * * * *

UNITED STATES PATENT AND TRADEMARK OFFICE

CERTIFICATE OF CORRECTION

PATENT NO. : 4,462,328

DATED : July 31, 1984

INVENTOR(S) : Stephen Oram

It is certified that error appears in the above—identified patent and that said Letters Patent is hereby corrected as shown below:

IN THE SPECIFICATION :

Column 1, line 31 delete "scrapping" insert --scraping--.

Column 1, line 41 delete "achored" insert --anchored--.

Column 1, line 45 after "previously" insert a hyphen -- - --.

Column 1, line 58 after "previously" insert a hyphen -- - --.

Column 2, line 7 delete "time-consuming" insert --time consuming--.

Column 3, line 22 delete "ship" and insert --ship's--.

Column 4, line 2 delete "and".

Column 4, line 4 delete "2." insert --2; and--.

Column 4, line 13 after "carriage" insert --12--.

Column 4, line 14 after "hull" insert --16--.

Column 4, line 15 delete "carriage." and insert --carriage 12.--.

Column 4, line 17 after "winch" insert --24--.

Column 4, line 18 after "ship" insert --18--.

Column 4, line 25 delete "27" insert --28--.

UNITED STATES PATENT AND TRADEMARK OFFICE

CERTIFICATE OF CORRECTION

PATENT NO. : 4,462,328

DATED : July 31, 1984

INVENTOR(S) : Stephen Oram

It is certified that error appears in the above—identified patent and that said Letters Patent is hereby corrected as shown below:

Column 4, line 46 after "hull" insert --16--.

Column 4, line 47 delete "florce" insert --force--.

Column 4, line 48 delete "nozzle" and insert --nozzles 30--

Column 4, line 49 delete "hull," insert --hull 16,--.

Column 4, line 50 delete "hulll" insert --hull--.

Column 4, line 50 after "hull" insert --16--.

Column 4, line 54 delete "hull." and insert --hull 16.--.

Column 4, line 57 after "nozzles" insert --30--.

Column 4, line 59 after "carriage" (second occurrence) insert --12--.

Column 4, line 60 delete "hull."and insert --hull 16.--

Column 4, line 62 delete "40" and insert --41--, both occurrences).

Column 4, line 62 delete "A" and insert --The--.

Column 4, line 63 delete "42" and insert --43--.

Column 4, line 65 delete "42" and insert --43--.

Column 5, line 1 delete "42" and insert --43--.

UNITED STATES PATENT AND TRADEMARK OFFICE

CERTIFICATE OF CORRECTION

PATENT NO. : 4,462,328

DATED : July 31, 1984

INVENTOR(S) : Stephen Oram

It is certified that error appears in the above—identified patent and that said Letters Patent is hereby corrected as shown below:

Column 5, line 6 delete "40" insert --41--.

Column 5, line 10 delete "40" insert --41--.

Column 5, line 21 after "carriage" insert --12--.

Column 5, line 22 after "hull" insert --16--.

Column 5, line 25 after "panel" insert --61--.

Column 5, line 26 after "carriage" (2nd and 3rd occurrences insert --12--.

Column 5, line 27 delete "hull." and insert --hull 16.--.

Column 5, line 28 after "fin" insert --60--.

Column 5, line 42 after "dock" insert --28--.

Column 5, line 44 delete "40" and insert --41--.

Column 5, line 49 delete "40" and insert --41--.

Column 5, line 57 delete "40" and insert --41--.

Column 5, line 59 delete "40" and insert --41--.

Column 6, line 2 after "carriage" insert --12--.

Column 6, line 2 after "hull" insert --16--.

Column 6, line 2 after "cables" insert --20 and 22--.

UNITED STATES PATENT AND TRADEMARK OFFICE

CERTIFICATE OF CORRECTION

PATENT NO. : 4,462,328

DATED : July 31, 1984

INVENTOR(S) : Stephen Oram

It is certified that error appears in the above—identified patent and that said Letters Patent is hereby corrected as shown below:

Column 6, line 3 after "fins" insert --60--.

Column 6, line 6 after "ship" insert --18--.

Column 6, line 11 after "hull" insert --16--.

Column 6, line 11 delete "ship." and insert --ship 18.--.

Column 6, line 13 delete "ship," and insert --ship 18,--.

Column 6, line 17 after "carriage" insert --12--.

Column 6, line 19 after "carriage" insert --12--.

Column 6, line 22 after "carriage" insert --12--.

Column 6, line 23 delete "nozzles." and insert --nozzles 30.--.

Column 6, line 30 delete "ship." and insert --ship 18.--.

Column 6, line 30 after "cables" insert --20 and 22--.

Column 6, line 31 delete "40" and insert --41--.

Column 6, line 34 delete "30" and insert --60--.

Column 6, line 35 delete "nozzle." and insert --nozzle 41.

Column 6, line 37 after "carriage" insert --12--.

Column 6, line 39 delete "40" and insert --41--.

UNITED STATES PATENT AND TRADEMARK OFFICE

CERTIFICATE OF CORRECTION

PATENT NO. : 4,462,328

DATED : July 31, 1984

INVENTOR(S) : Stephen Oram

It is certified that error appears in the above—identified patent and that said Letters Patent is hereby corrected as shown below:

Column 6, line 41 delete "ship." and insert --ship 18.--.

Column 6, line 42 delete "40" and insert --41--.

Column 6, line 45 after "surface" insert --16--.

Column 6, line 46 delete "ship." insert --ship 18.--.

Column 6, line 48 after "winches" insert --24 and 26--.

Column 6, line 48 after "carriage" insert --12--.

Column 6, line 49 delete "ship." and insert --ship 18.--.

Column 6, line 52 after "ship" insert --18--.

Column 6, line 53 after "hull" insert --16--.

Column 6, line 57 after "carriage" insert --12--.

Column 6, line 62 delete "have" and insert --having--.

IN THE CLAIMS:

Claim 8, line 3 delete "the" and insert --a--.

Claim 14, line 50 delete "and".

Claim 14, line 54 after "members;" insert --and--.

Claim 14, line 62 delete "fourth" and insert --fifth--.

UNITED STATES PATENT AND TRADEMARK OFFICE

CERTIFICATE OF CORRECTION

PATENT NO. : 4,462,328

DATED : July 31, 1984

INVENTOR(S) : Stephen Oram

It is certified that error appears in the above—identified patent and that said Letters Patent is hereby corrected as shown below:

IN THE ABSTRACT:

Line 2, delete "sea going" and insert --seagoing--.

Line 4, delete "opposed" and insert --opposes--.

Signed and Sealed this

Ninth Day of April 1985

[SEAL]

*Attest:*

DONALD J. QUIGG

*Attesting Officer*

*Acting Commissioner of Patents and Trademarks*